US005434349A

United States Patent [19]

Kawamura

[11] Patent Number: 5,434,349

[45] Date of Patent: Jul. 18, 1995

[54] KEYBOARD INSTRUMENT SELECTIVELY ENTERING INTO AN ACOUSTIC MODE AND A SILENT MODE THROUGH A SLIDING MOTION OF A STOPPER

[75] Inventor: Kiyoshi Kawamura, Shizuoka, Japan

[73] Assignee: Yamaha Corporation, Japan

[21] Appl. No.: 215,295

[22] Filed: Mar. 21, 1994

[30] Foreign Application Priority Data

Mar. 22, 1993 [JP] Japan ..... 5-062143
Nov. 30, 1993 [JP] Japan ..... 5-323434

[51] Int. Cl.[6] ..... G10C 5/00; G10D 15/00; G10H 1/34

[52] U.S. Cl. ..... 84/719; 84/2; 84/3; 84/171; 84/236

[58] Field of Search ..... 84/719, 720, 2, 3, 170–172, 84/236, 423 R, 433

[56] References Cited

U.S. PATENT DOCUMENTS

| | | | |
|---|---|---|---|
| 533,661 | 2/1894 | McChesney et al. . | |
| 537,533 | 10/1894 | McChesney et al. . | |
| 2,250,065 | 7/1941 | Koel | 84/171 |
| 4,633,753 | 1/1987 | Takahashi | 84/220 |
| 4,704,931 | 11/1997 | Nagai | 84/171 X |
| 4,744,281 | 3/1987 | Isozaki | 84/171 X |
| 4,970,929 | 11/1990 | Ishida | 84/120 |
| 5,001,339 | 3/1991 | Starkley et al. | 250/229 |
| 5,115,705 | 5/1992 | Monte et al. | 84/617 |
| 5,247,129 | 9/1993 | Nozaki et al. | 84/615 |

FOREIGN PATENT DOCUMENTS

| | | |
|---|---|---|
| 0270966A2 | 6/1988 | European Pat. Off. . |
| 0573963A2 | 12/1993 | European Pat. Off. . |
| 97885 | 10/1897 | Germany . |
| 44782 | 9/1898 | Germany . |
| 3707591C1 | 5/1988 | Germany . |
| T091U0077 | 10/1992 | Italy . |
| 51-67732 | 5/1976 | Japan . |
| 55-55880 | 4/1980 | Japan . |
| 62-32308 | 8/1987 | Japan . |
| 63-97997 | 4/1988 | Japan . |

*Primary Examiner*—Stanley J. Witkowski
*Attorney, Agent, or Firm*—Graham & James

[57] ABSTRACT

A keyboard instrument selectively enters into an acoustic sound mode for producing piano tones and into an electronic sound mode for producing synthetic tones, and comprises an acoustic piano, an electronic sound generating system and a mode controlling system, wherein the mode controlling system has a stopper slidable along strings of the acoustic piano so that the strings are struck by or blocked from hammers of the acoustic depending upon the position of the stopper.

5 Claims, 13 Drawing Sheets

KEYBOARD INSTRUMENT SELECTIVELY ENTERING INTO AN ACOUSTIC MODE AND A SILENT MODE THROUGH A SLIDING MOTION OF A STOPPER

FIELD OF THE INVENTION

This invention relates to a keyboard instrument and, more particularly, to a keyboard instrument selectively entering into an acoustic sound mode and a silent mode.

DESCRIPTION OF THE RELATED ART

While a player is practicing a piano, some neighbors feel the piano tones discomfortable, and wants to practice without disturbance of the neighborhood. Various mufflers have been proposed for acoustic pianos, and one of the mufflers is disclosed in Japanese Unexamined Publication (Kokai) of Utility Model Application No. 51-67732, and the muffler is implemented by a shock absorber downwardly movable for decreasing the loudness of piano tones. Namely, while a player is performing a music with a standard volume, the shock absorber remains in an spaced position from hammer shanks, and depressed keys causes the associated key action mechanisms to rotate the hammer heads for striking the strings without interruption of the shock absorber. However, if the player wants to perform a music with small tones, the shock absorber is pulled down toward the hammer shanks, and becomes engageable with the hammer shanks. In this situation, while the player depresses the keys, the hammer shanks and the hammer heads concurrently strike the associated strings and the shock absorber, and, for this reason, the strings weakly vibrate for producing the piano tones.

However, the muffler disclosed in the Japanese Unexamined Publication can not perfectly extinguish the piano tones, and the disturbance takes place under a performance with the decreased piano tones.

Another prior art grand piano disclosed in U.S. Pat. No. 2,250,065 perfectly extinguishes the piano tones, and a silent mechanism incorporated in the prior art grand piano prevents the neighborhood from the disturbance. The silent mechanism disclosed in the U.S. Patent spaces the hammer assemblies from the associated jacks, and does not allow the jacks to rotate the hammer assemblies. In other words, even if a player depresses the keys, the depressed keys only push up the associated whippen assemblies, and the jacks do not reach the hammer assemblies.

Although the silent mechanism disclosed in the U.S. Patent protects the neighborhood against the piano tones, the player feels the key-touch strange. An ordinary acoustic piano gives a unique key-touch to a player, and an escape of the jack from the hammer assembly produces the unique key-touch. Therefore, the prior art silent mechanism destroys the unique key-touch, and a player can not practice the fingering on the keyboard for a recital.

SUMMARY OF THE INVENTION

It is therefore an important object of the present invention to provide a keyboard instrument which can perfectly extinguish piano tones without sacrifice of the unique key- touch.

To accomplish the object., the present invention proposes to stop a rotation of a hammer assembly with a stopper slidable in parallel to strings before a strike against the strings.

In accordance with the present invention, there is provided a keyboard instrument having at least an acoustic sound mode for producing acoustic sounds and an electronic sound mode for producing synthetic sounds, comprising: a) an acoustic piano having a-1) a keyboard implemented by a plurality of swingable keys depressed by a player in both acoustic sound and electronic sound modes, notes of a scale being assigned to the plurality of swingable keys, a-2) a plurality of key action mechanisms respectively linked with the plurality of swingable keys, and selectively actuated by depressed keys of the keyboard in both acoustic sound and electronic sound modes, a-3) a plurality of hammer assemblies respectively associated with the plurality of key action mechanisms, and selectively driven for rotation by actuated key action mechanisms linked with the depressed keys in both acoustic sound and electronic sound modes, the actuated key action mechanisms and the associated hammer assemblies producing a piano-touch in both acoustic sound and electronic sound modes, and a-4) a plurality of string means respectively associated with the plurality of hammer assemblies, and selectively struck by hammer assemblies driven by the actuated key action mechanisms in the acoustic sound mode for producing the acoustic sounds, a gap between each hammer assembly and the associated string means being increased from an axis of rotation thereof toward an leading end portion thereof while the associated key in a rest position allows the hammer assembly to stay in a home position; b) an electronic sound generating system enabled in the electronic sound mode for producing synthetic sounds having notes identified by the depressed keys; and c) a mode controlling system having c-1) a stopper means provided in the gap and movable at least between a free position in said acoustic sound mode and a blocking position in the electronic sound mode, the blocking position being closer to the plurality of hammer assemblies in home positions, and c-2) a driving means associated with the stopper means and movable along the plurality of string means for changing the stopper means between the free position and the blocking position, the hammer assemblies striking the string means without an interruption of the stopper means in the free position, the hammer assemblies being brought into contact with the stopper means in the blocking position without a strike against said string means.

BRIEF DESCRIPTION OF THE DRAWINGS

The features and advantages of the keyboard instrument according to the present invention will be more clearly understood from the following description taken in conjunction with the accompanying drawings in which.

DESCRIPTION OF THE PREFERRED EMBODIMENTS.

First Embodiment

Figure 1:
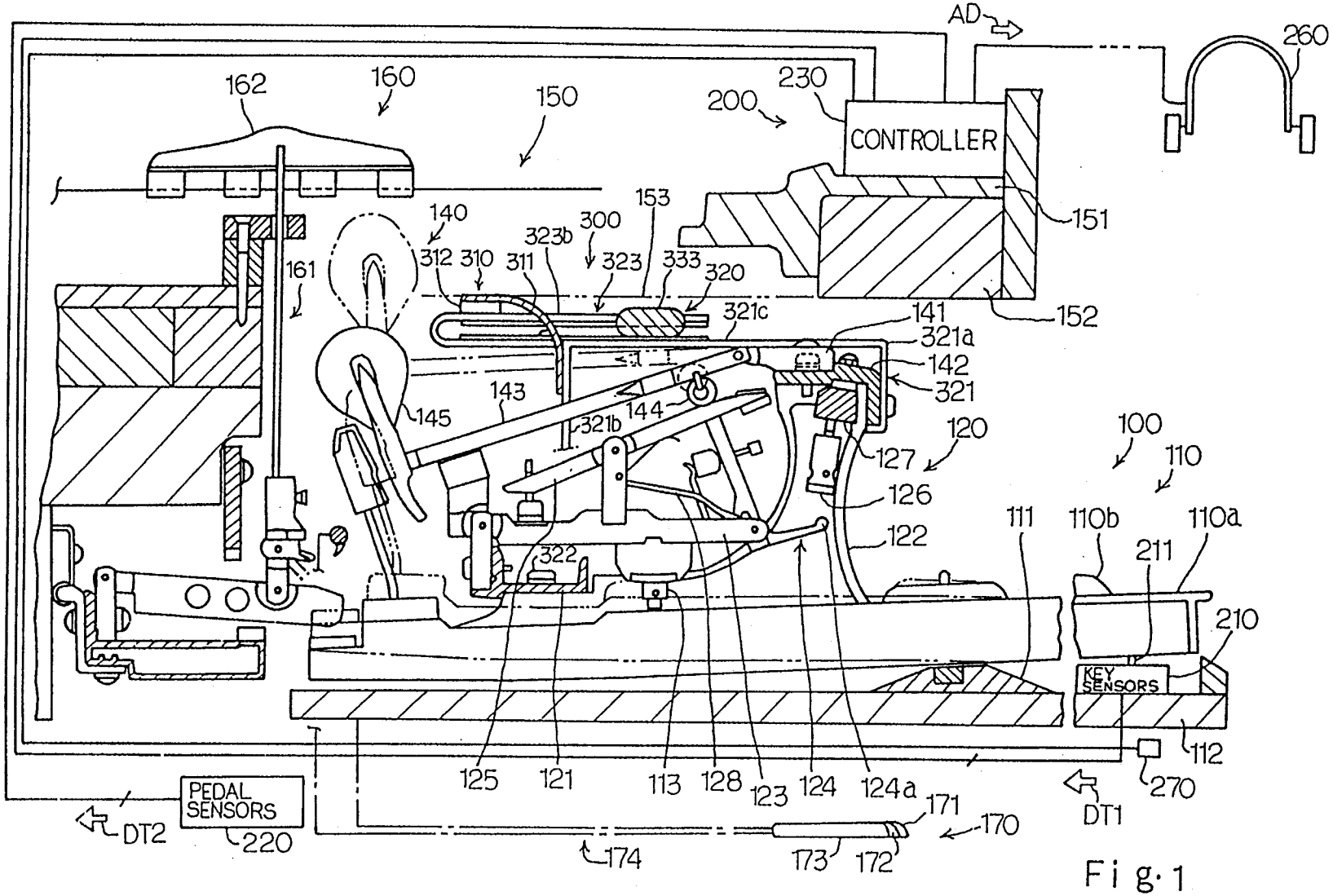
FIG. 1 is a cross sectional side view showing essential parts of a keyboard instrument according to the present invention.

Referring first to FIG. 1 of the drawings, a keyboard instrument embodying the present invention largely comprises a grand piano 100, an electronic sound generating system and a mode controlling system 300, and selectively enters into an acoustic sound mode for a performance with acoustic tones, a faint sound mode for a performance in a small volume and a silent mode without the acoustic tones. In this instance, the silent mode is broken down into a true silent sub-mode for a fingering in a perfect silence and an electronic sound mode for a performance with synthetic tones, and the synthetic tones are electronically produced by the electronic sound generating system 200. Although the synthetic tones usually have a timbre identical with the acoustic tones, the electronic sound generating system 200 can impart any timbre to the synthetic tones.

In the following description, words "clockwise" and "counter clockwise" are determined on the drawing where the rotational component is illustrated, and "front" is closer to a player in front of a keyboard than "rear".

The acoustic piano 100 is of the grand type, and is constructed as similar to an ordinary grand piano. Namely, the acoustic piano 100 comprises a keyboard 110 implemented by eighty-eight black and white keys 110*a* and 110*b*, and the black and white keys 110*a* and 110*b* are turnably supported by a center rail 111 on a stationary key bed structure 112.

The acoustic piano 100 further comprises a plurality of key action mechanisms 120 respectively linked with capstan screws 113 of the black and white keys 110*a* and 110*b*, and the key action mechanisms 120 are turnably supported by a whippen rail 121. The whippen rail 121 in turn is supported by action brackets 122 mounted on respective bracket blocks (not shown) on the key bed structure 112. Each of the key action mechanism 120 includes a whippen assembly 123 turnable with respect to the whippen rail 121, a jack 124 turnable with respect to the whippen assembly 123, a repetition lever 125 swingable with respect to the whippen assembly 123, a regulating button 126 supported a regulating rail 127 stationary with respect to the action brackets 122 and a repetition spring 128 inserted between the whippen assembly 123 and the jack 124. Although a hammer shank stop felt, a repetition lever button, etc. are further incorporated in the key action mechanism 120, description is omitted for the sake of simplicity.

The acoustic piano 100 further comprises hammer assemblies 140 respectively associated with the key action mechanisms 120, and each hammer assembly 140 comprises a hammer shank flange 141 bolted to a shank flange rail 142 which in turn is supported by the action brackets 122, a hammer shank 143 turnable with respect to the hammer shank flange 141, a hammer roller 144 rotatably connected with the hammer shank 143 and a hammer head 145 attached to the leading end portion of the hammer shank 143. The top end of the jack 124 passes through the repetition lever 125, and is held in contact with the hammer roller 144 before an escape from the hammer roller 144.

The acoustic piano 100 further comprises a plurality sets of strings respectively struck by the hammer heads 145, damper mechanisms 160 for damping vibrations on the strings 150 and a pedal mechanism 170 for imparting predetermined effects on the acoustic tones produced through the vibrations of the strings 150. Each of the damper mechanisms 160 has a link mechanism 161 engageable with the rear end portion of the associated key 110*a* or 110*b* and a damper head 162 engageable with the associated set of strings 150, and the pedal mechanism 170 has a damper pedal 171, a muffler pedal 172, a soft pedal 173 and the associated link sub-mechanisms 174. The strings 150 horizontally extends over the hammer assemblies 140, and are anchored at a plate 151 on a pin block 152. Reference numeral 153 is indicative of a virtual surface coplanar with the lower surface of the pin block 152. The damper mechanisms 160 and the pedal mechanism 170 indirectly relate to the present invention, and no further description is incorporated hereinbelow.

When a player depresses a key 110*a* or 110*b* in any one of the above described modes, the capstan button 113 on the depressed key 110*a* or 110*b* pushes up the whippen assembly 123, and the rear end portion of the depressed key 110*a* or 110*b* spaces the associated damper head 162 from the set of strings 150. The whippen assembly 123 and the jack 124 rotates in the counter clockwise direction around the whippen rail 121 without a relative motion therebetween, and the jack 124 pushes the hammer roller 144. The hammer shank 143 rotates around the hammer shank flange 141 in the clockwise direction.

The toe 124*a* of the jack 124 is brought into contact with the regulating button 126, and starts to turn around the whippen assembly 123 against the repetition spring 128. The jack 124 finally escapes from the hammer roller 144, and kicks the hammer assembly 140. Then, the hammer assembly 140 rushes toward the strings 150, and the key action mechanism 120 and the hammer assembly 140 give the unique key-touch to the player at the escape. Thus, the keyboard instrument embodying the present invention gives the unique key-touch to the player in the acoustic, faint and silent modes.

The electronic sound generating system 200 comprises a plurality of key sensors 210 respectively associated with the black and white keys 110*a* and 110*b* for monitoring the keys, a plurality of pedal sensors 220 for monitoring link sub-mechanisms of the peal mechanism 170, a controller 230 for producing an audio signal AD, a headphone 260 for producing the synthetic tones from the audio signal AD and a mode shift switch 270. A keyboard instrument according to the present invention may further comprise a plurality of hammer sensors for monitoring the hammer assemblies 140 and/or a speaker system.

Each of the key sensors 210 is implemented by a shutter plate 211 and a photo-interrupter, and the shutter plate 211 and the photo-interrupter are respectively fixed to the associated key 110*a* or 110*b* and to the key bed structure 112. A plurality of different slit patters are formed in the shutter plate 211, and the photo-interrupter changes a detecting signal DT1 when the plurality of slit patterns sequentially passes through an optical path.

Each of the pedal sensors 220 also changes a detecting signal DT2 depending upon the position of the associated pedal, and the mode shift switch 270 is manipulated by a player for producing a mode signal MODE indicative of one of the acoustic/faint mode and the silent mode.

Figure 2:
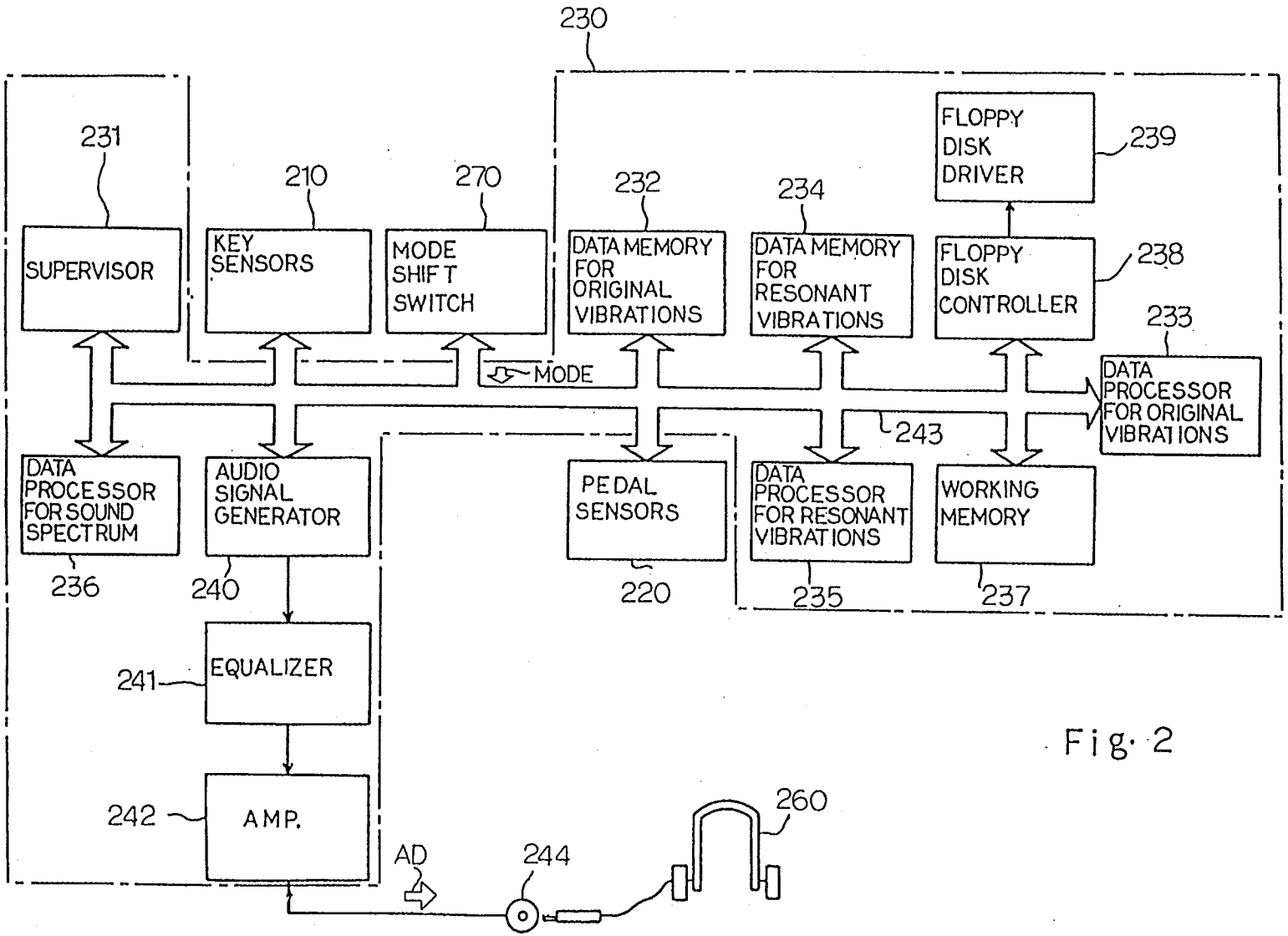
FIG. 2 is a block diagram showing the arrangement of an electronic sound generating system incorporated in the keyboard instrument according to the present invention.

Turning to FIG. 2 of the drawings, the electronic sound generating system 200 comprises a supervisor 231, a data memory 232 for original vibrations, a data processor 233 for original vibrations, a data memory 234 for resonant vibrations, a data processor 235 for resonant vibrations, a data processor 236 for sound spectrum, a working memory 237, a floppy disk controller 238, a floppy disk driver 239, an audio signal generator 240, an equalizer 241, an amplifier 242 and a bus system 243.

The mode shift switch 270 supplies the mode signal MODE to the controller 230, and the mode signal MODE is assigned to one of the signal input ports of the controller 230. The other signal input ports are assigned the key sensors 210 and the pedal sensors 220.

The supervisor 231 sequentially scans the signal input ports assigned to the mode control signal MODE, the detecting signals DT1 from the key sensors 210 and the detecting signals DT2 from the pedal sensors 220, and supervises the other components 232 to 240 for producing the audio signal AD.

An internal table is incorporated in the supervisor 231, and the internal table defines relation between the key numbers already assigned to the keys 110*a* and 110*b*, key velocity and timings for producing the audio signal AD. The audio signal AD is supplied from the audio signal generator 240 through the equalizer 241 and the amplifier unit 242 to the headphone 260 in the electronic sound sub-mode. However, if the player pulls out the headphone 260 from a socket 244, the player can practice the fingering on the keyboard 110 in the true silent sub-mode.

Various internal registers are incorporated in the supervisor 231, and one of the internal registers is assigned to a mode flag indicative of the presently designated mode.

The data memory 232 for original vibrations stores a plurality sets of pcm (Pulse Code Modulation) data codes indicative of frequency specular of original vibrations on the strings 150, and each set of pcm data codes is corresponding to one of the keys 110*a* and 110*b*. A plurality groups of pcm data codes form a set of pcm data codes, and are corresponding to frequency specular at different intensities or hammer velocity. In general, if a hammer head 145 strongly strikes the associated strings 150, higher harmonics are emphasized.

The plurality sets of pcm data codes are produced with a sampler (not shown) through sampling of actual vibrations on the sets of strings 150 at appropriate sampling frequency. However, the set of pcm data codes may be produced by means of the data processor 236 through a real-time manner. Using a group of pcm data codes, original vibrations produced upon depressing a key 110*a* or 110*b* are restored, and the supervisor 231 controls the sequential access to a group of pcm data codes stored in the data memory 232.

The data processor 233 for original vibrations is provided in association with the data memory 232, and modifies a group of pcm data codes for an intermediate hammer velocity. The modification by the data processor 233 is also controlled by the supervisor 231.

As described hereinbefore, the intensity of frequency spectrum is corresponding to the hammer velocity. However, the intensities are variable with the type and model of the acoustic piano 100.

The data memory 234 for resonant vibrations stores a plurality sets of pcm data codes indicative of resonant vibrations, and the resonant vibrations take place under a manipulation of the damper pedal 171. While a player is stepping on the damper pedal 171, the damper heads 162 are held off, and some of the related strings are resonant with the strings directly struck by the associated hammer head 145. The resonant tones range −10 dB and −20 dB with respect to the tone originally produced at the strike with the hammer head 145, and time delay of several millisecond to hundreds millisecond is introduced between the originally produced tone and the resonant tones.

If the player continuously steps on the damper pedal 171, the resonant tones continues several seconds. However, the player may rapidly terminate the original and resonant tones by releasing the damper pedal 171, and the audio signal generator 240 is responsive to the detecting signal DT2 of the pedal sensors 220 for the rapidly extinguishing the tones.

The pcm data codes stored in the data memory 234 are indicative of frequency specular of the resonant vibrations, and are also produced by means of the sampler or the data processor 236 for resonant vibrations.

Each of the plurality sets of pcm data codes for the resonant tones is addressable with the detecting signal DT1 indicative of the depressed key 110*a* or 110*b*, and is constituted by six groups of pcm data codes at the maximum. Each group of pcm data codes is corresponding to one of the resonant strings 150, and the second harmonic to the sixth harmonic are taken into account for strings one octave higher than low-pitched sounds. However, if the depressed key is lower than the thirteenth key with respect to the lowest key, the string one octave lower than the depressed key should be taken into account.

A set of pcm data codes are sequentially read out from the data memory 234 depending upon the depressed key 110*a* or 110*b* under the control of the supervisor 231, and the data processor 235 for resonant vibrations modifies the pcm data codes for an intermediate intensity. The memory capacity of the data memory 234 may be large enough to store the pcm data codes at all of the detectable hammer velocities, and the data processor 235 may calculate each set of pcm data codes on the basis of parameters stored in the data memory 234.

The data processor 236 for sound spectrum can produce not only a group of pcm data codes indicative of frequency spectrum for original vibrations but also a set of pcm data codes indicative of frequency specular for resonant vibrations as described hereinbefore. The data processor 236 is further operative to cause the frequency specular to decay. In detail, when a player releases a key of an acoustic piano, original vibrations on a set of strings rapidly decays, because an associated damper head is brought into contact with the strings again. In the electronic sound generating system 200, the data processor 236 simulates the decay of the vibrations, and sequentially decreases the values of the pcm data codes. The resonant tones continue for several seconds in so far as the player keeps the damper pedal 171 in the depressed state. However, if the player releases the damper pedal 171, the resonant tones are rapidly decayed. The data processor 236 also simulates the decay, and sequentially decreases the values of the pcm data codes for the resonant vibrations.

The decay is not constant. If the player releases the damper pedal 171 through a half pedal, the tones decay at lower speed rather than the ordinary release. Moreover, some players use the half pedal in such a manner as to retard low-pitched tones rather than high-pitched tones, and such a pedal manipulation is called as an oblique contact. On the contrary, if the damper pedal 171 causes all the dampers to be simultaneously brought into contact with the strings 150, the damper manipulation is referred to as simultaneous contact. The data processor 236 further simulates the gentle decay for the release through the half pedal as well as the oblique contact, and the values of the pcm data codes are decreased at either high, standard or low speed in the simultaneous contact and at different speed in the oblique contact. The data processor 236 may change the ratio between the fundamental tone and the harmonics thereof for the half pedal, and decay high-order harmonics faster than the fundamental tone. The frame of an acoustic piano usually vibrates, and the frame noise participates in the piano tone. The data processor 236 may take these secondary noise into account and modify the frequency ratio.

The audio signal generator 240 comprises a digital filter, a digital-to-analog converter and a low-pass filter, and produces the analog audio signal from the pcm data codes supplied from the data memories 232 and 234 and/or the data processors 233, 235 and 236. The pcm data codes are subjected to a digital filtering, and are, then, converted into the analog audio signal AD. If a speaker system is incorporated in the electronic sound producing system 200, the vibration characteristics of the speaker system and a speaker box would be taken into account for the digital filtering. In either case, the pcm data codes are modified in such a manner that the frequency spectrum of produced sounds becomes flat. The digital filter is of the FIR type. However, an IIR type digital filter is available. An oversampling type digital filter may follow the digital filtering for eliminating quantized noises.

After the digital filtering, the digital-to-analog converter produces the analog audio signal AD, and the analog audio signal AD is filtered by the low-pass filter. The low-pass filter is of a Butterworth type for improving group delay. The analog audio signal AD thus filtered is supplied through the equalizer 221 to the amplifier unit 242, and the amplifier unit 242 amplifies the analog audio signal AD for driving the headphone 260.

The floppy disk driver 239 reads out data codes formatted in accordance with the MIDI standards from a floppy disk under the control of the floppy disk controller 238, and the supervisor 231 allows the audio signal generator 240 to reproduce sounds from the data codes read out from the floppy disk. Therefore, a music can be reproduced in the timbre of another musical instrument such as, for example, a pipeorgan, a harpsichord or a wind musical instrument.

The supervisor 211 may format the detecting signals D1 of the key sensors 210 and the detecting signals D2 of the pedal sensors 220 in accordance with the MIDI standards, and the MIDI codes are stored in a floppy disk under the control of the floppy disk controller 238. If the keyboard instrument can record and reproduce a performance, the keyboard instrument has five modes of operation, i.e., the acoustic sound mode, the silent mode, the faint mode, the recording mode and the playback mode, and the silent mode also has two sub-modes.

Turning back to FIG. 1 of the drawings, the mode controlling system 300 is provided in a gap between the hammer assemblies 140 and the plurality sets of strings 150, and largely comprises a stopper mechanism 310 shiftable between a free position closer to the strings 150 and a blocking position spaced from the strings 150 and a driving mechanism 320 slidable along the strings 150 for changing the stopper mechanism 310 between the free position and the blocking position.

While the keys 110*a* and 110*b* are staying in respective rest positions, the hammer assemblies 140 return to their home positions shown in FIG. 1, and a gap between the hammer shanks 143 and the strings 150 is increased from the hammer shank flanges 141 toward the leading ends of the hammer shanks 143. In this situation, the driving mechanism 320 slidable along the strings 150 is insertable into the gap from the hammer shank flanges 141 toward the leading ends of the hammer shanks 143, and the stopper mechanism 310 movable in the direction perpendicular to the strings is only locatable in the gap in the vicinity of the leading ends of the hammer shanks 143.

The driving mechanism 320 has a plurality of first frame members 321 fixed at front end portions 321*a*-thereof to the shank flange rail 142 and the hammer shank flanges 141 and at the rear end portions thereof 321*b* to a support member 322 on the whippen rail 121. The intermediate portions 321*c* of the first frame members 321 extend between the front end portions 321*a* and the rear end portions 321*b* substantially in parallel to the virtual plane 153.

Figure 3:
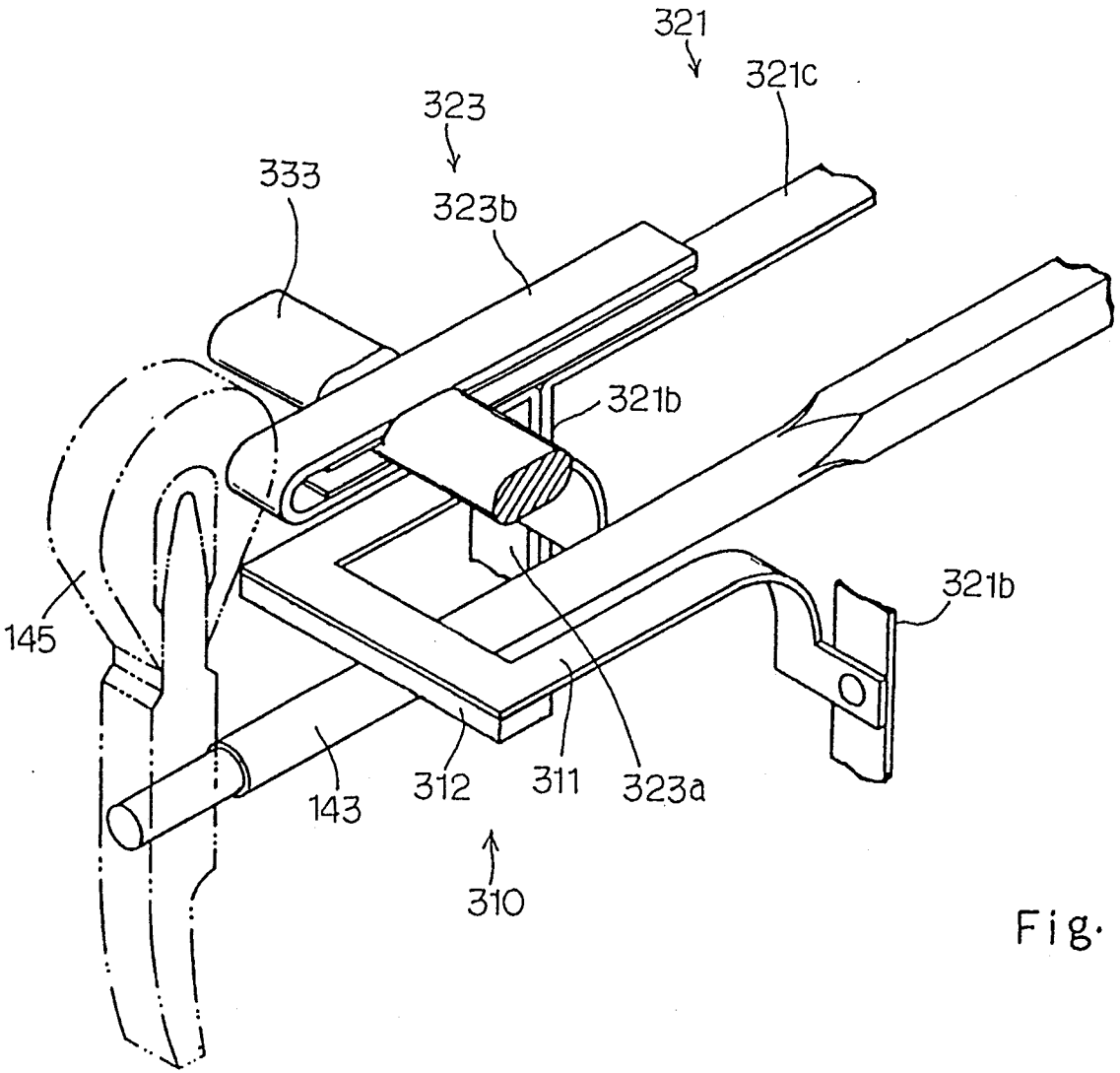
FIG. 3 is a perspective view showing the structure of a mode controlling system incorporated in the keyboard instrument.

The driving mechanism 320 further has a plurality of second frame members 323 each shared between a predetermined number of the first frame members 321, and are fixed at vertical portions 323*a* thereof to the rear end portions 321*b* of selected first frame members 321 as will be better seen from FIG. 3. The second frame members 323 have respective turn-back portions 323*b* substantially coplanar with the intermediate portions 321*c* of the selected first frame members 321.

The driving mechanism 320 further has a pusher 333 shared between all of the second frame members 323, and the pusher 333 has a groove engaged with the turn-back portions 323*b*. Though not shown in the drawings, a suitable link mechanism is connected with the pusher 333, and a player manipulates the link mechanism so that the pusher 333 slides along the virtual plain 153 and the strings 150. The pusher 333 is rigid, and is formed of metal or hard plastic. The link mechanism connected with the pusher 333 is further linked with the mode shift switch 270, and the player can shift the keyboard instrument between the modes through the manipulation of the link mechanism. In other keyboard instruments according to the present invention, the pusher 333 may be driven by an electronic motor associated with a suitable converting mechanism between a rotation and a reciprocal motion or by a solenoid-operated actuator. The electric motor and the solenoid-operated actuator may be controlled by the controller 230 in response to the mode signal MODE.

The stopper mechanism 310 has a plurality of deformable frame members 311 respectively associated with the hammer assemblies 140 and a plurality of cushion members 312 respectively attached to the deformable frame members 311, and the deformable frame members 311 are fixed to the rear end portions 321*b* of the first frame members 321 such that the cushion members 312 are faced to the hammer shanks 143 of the associated hammer assemblies 140 in the home positions. the cushion members 312 are formed of felt, cloth, urethane foam or rubber foam.

When the pusher 333 is spaced from the deformable frame members 311, the deformable frame members 311 lift the cushion members 312 in the vicinity of the virtual plane 153, and the cushion members 312 are spaced from the hammer shanks 143. In other words, the stopper mechanism 310 is staying in the free position, and the hammer heads 145 can strike the associated strings 150 without interruption of the cushion members 312.

If the pusher 333 is moved from a home position toward the rear end of the keyboard instrument along the turn-back portions 323*b*, the pusher 333 is brought into contact with the deformable frame members 311, and deforms the frame members 311 such that the cushion members 312 becomes closer to the hammer shanks 143 in the home positions. If the pusher 333 is further moved toward the rear end of the keyboard instrument, the deformable frame members 311 are further deformed, and the cushion members 312 become much closer to the hammer shanks 143. However, if the pusher 333 returns to the home position, the deformable frame members 311 allows the cushion members 312 to return to the initial positions.

If the stopper mechanism 310 enters into a muffler position, the hammer shanks 143 are brought into contact with the cushion members 312, and the hammer heads 145 softly strike the associated strings 150. In other words, the hammer assemblies 140 concurrently strike the associated cushion members 312 and the associated strings 150. However, when the stopper mechanism 310 enters into the blocking position, the hammer assemblies 140 are brought into contact with the cushion members 312 without strike against the strings 150.

Description is hereinbelow made on the acoustic mode, the faint mode and the silent mode of operation. If the player moves the pusher 333 in its home position shown in FIG. 1, the stopper mechanism 310 returns to the free position, and the mode shift switch 270 supplies the mode signal MODE indicative of the acoustic sound mode. The controller 230 ignores the detection signals D1 and D2, and the audio signal AD is never produced. If the player starts to perform a music on the keyboard 110, the key action mechanisms 120 associated with the depressed keys rotate the hammer assemblies 140, and cooperate therewith so as to give the piano key-touch to the player. The hammer assemblies 140 thus driven by the key action mechanisms 120 strike the associated strings 150 without an interruption of the stopper mechanism 310, and the strings 150 vibrate for producing acoustic tones.

Figure 4:
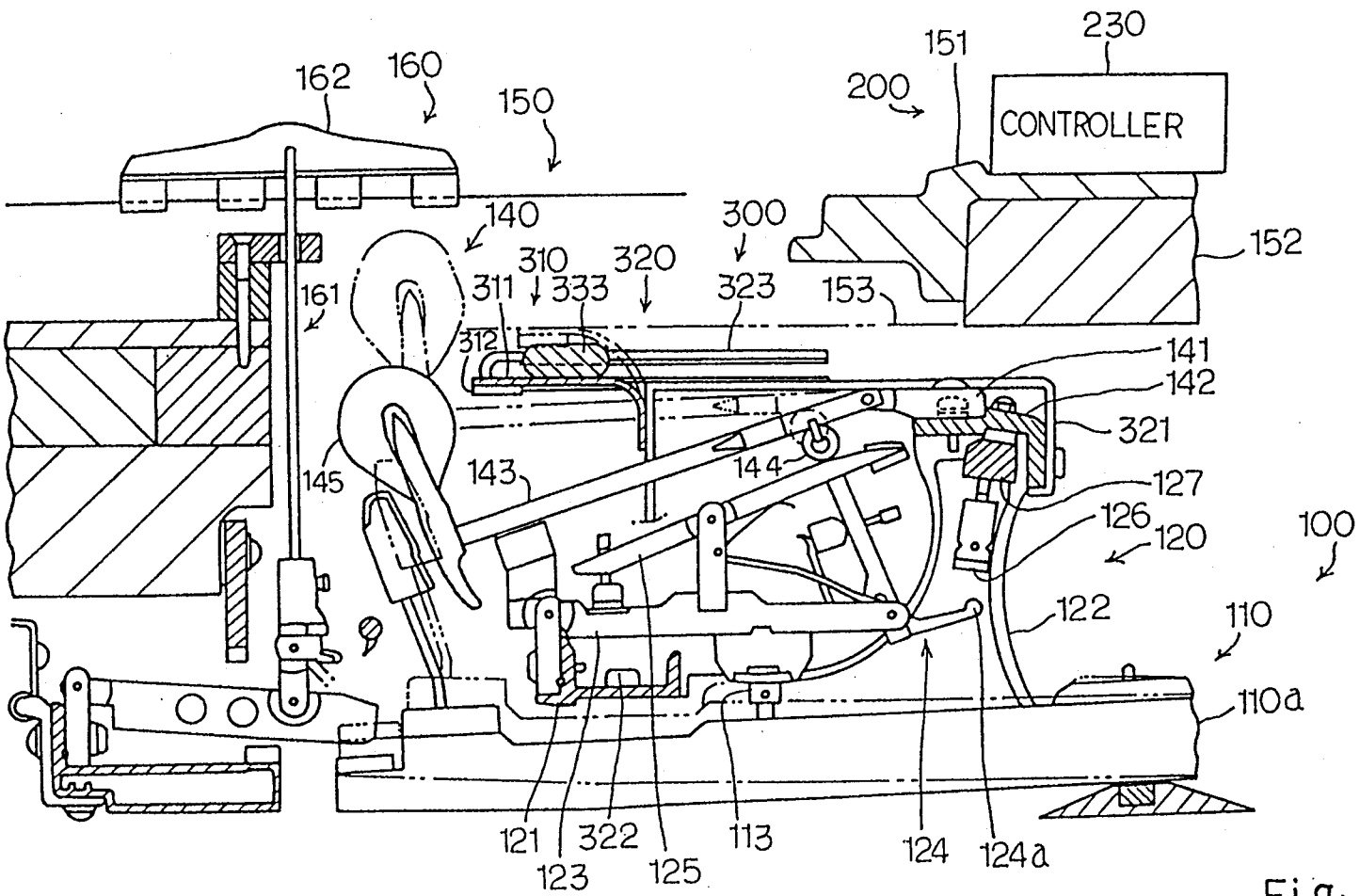
FIG. 4 is a cross sectional side view showing the essential parts of the keyboard instrument in a silent mode.

If the player manipulates the link mechanism for moving the pusher 333 to the rearmost position as shown in FIG. 4, the mode shift switch 270 supplies the mode signal MODE indicative of the silent mode to the controller 230. If the player inserts the jack of the headphone 260 to the socket 244, the keyboard instrument enters into the electronic sound sub-mode, and the player can hear the synthetic tones through the headphone. However, if the jack is pulled out, the keyboard instrument enters into the true silent sub-mode, and the player can practice the fingering on the keyboard 110 in a perfectly silent ambience.

After the entry into the silent mode, if the player performs a music on the keyboard 110, the controller 230 communicates with the key sensors 210 and the pedal sensors 220 for producing the audio signal AD. The key action mechanisms 120 give the piano key-touch to the player in cooperation with the hammer assemblies 140. However, the strings 150 are blocked from the hammer heads 145 by means of the stopper mechanism 310, and never vibrate for producing an acoustic tone.

If the player causes the pusher 333 to return to an intermediate position between the rearmost position shown in FIG. 4 and the initial position shown in FIG. 1, the keyboard instrument enters into the faint mode, and the hammer assemblies 140 can concurrently strike the associated strings 150 and the associated cushion members 12. In the faint mode, while the player is performing a music on the keyboard 110, the hammer assemblies 140 give the piano-touch to the player in cooperation with the key action mechanisms 120, and softly strike the associated strings 150 due to the interruption of the stopper mechanism 310. As a result, the strings 150 faintly vibrate for producing acoustic tones, and the volume is smaller than those in the acoustic mode.

If the keyboard instrument has the recording mode and/or the playback mode, the player can record the music performed in either acoustic or silent mode in a floppy disk, and can reproduce the music in the playback mode.

As will be appreciated from the foregoing description, the keyboard instrument according to the present invention gives the piano-touch to the player in both acoustic and electronic sound modes, and allows the player to practice a fingering on the keyboard without an acoustic sounds.

Second Embodiment

Figure 5:
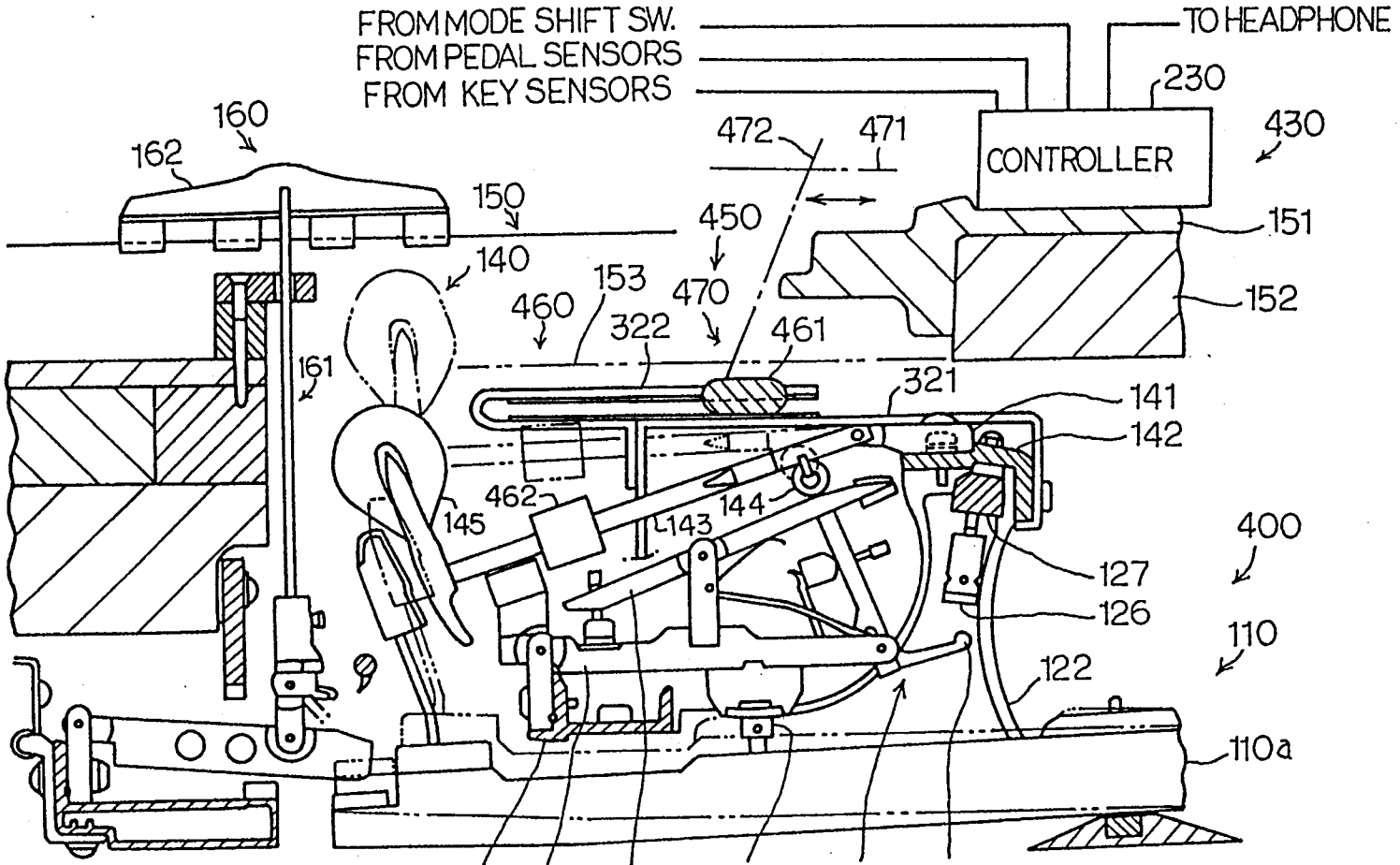
FIG. 5 is a cross sectional side view showing essential parts of another keyboard instrument according to the present invention.

Turning to FIG. 5 of the drawings, another keyboard instrument embodying the present invention also largely comprises an acoustic piano 400, an electronic sound generating system 430 and a mode controlling system 450, and selectively enters into the acoustic mode, the silent mode and the faint mode as similar to the first embodiment. The silent mode has the two sub-modes, i.e., the true silent sub-mode and the electronic sound sub-mode, and the recording mode and the playback mode may be further selectively established in the keyboard instrument implementing the second embodiment.

The acoustic piano 400 and the electronic sound generating system 430 are similar to those of the first embodiment, and, for this reason, the component members and mechanisms thereof are labeled with the same references as those of the first embodiment without detailed description.

The mode controlling system also largely comprises a stopper mechanism 460 and a driving mechanism 470, and the driving mechanism 470 is constructed by the first and second frame members 321 and 322 and link members 471 and 472. However, the pusher 333 is deleted from the driving mechanism 470, and is replaced with a slider 461 forming a part of the stopper mechanism 460.

Figure 6:
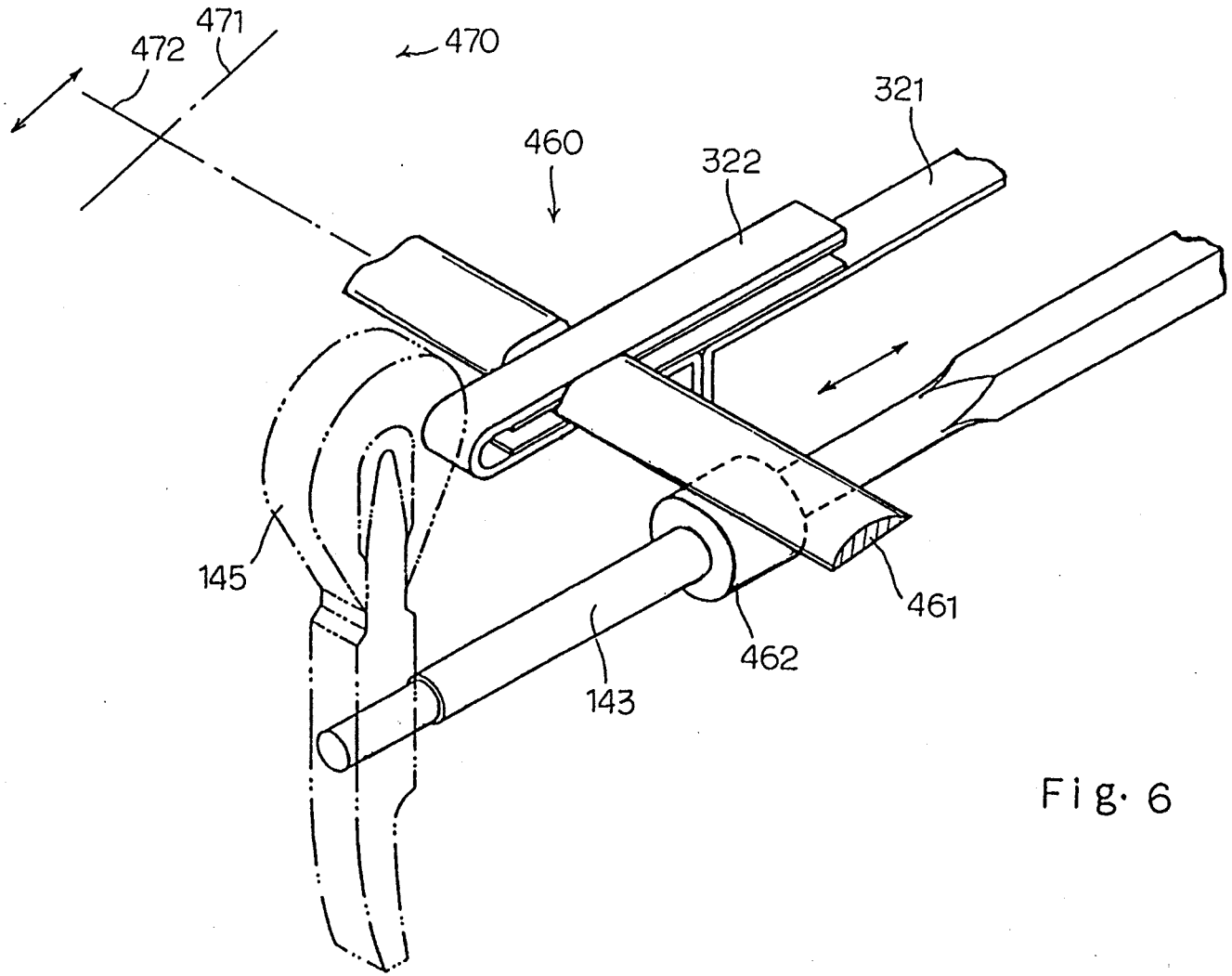
FIG. 6 is a perspective view showing the structure of a mode controlling system incorporated in the keyboard instrument shown in FIG. 5.

The stopper mechanism 460 comprises the slider 461 and a plurality of cushion members 462, and the link member 472 is connected with the slider 461. As will be better seen from FIG. 6 of the drawings, when a player pulls and pushes the link member 471, the link mechanism 472 and the slider 461 slide along the virtual plane 153, and the second frame member 322 guides the slider 461. The cushio members 462 is formed of felt, cloth, urethane foam or rubber foam.

Figure 7:
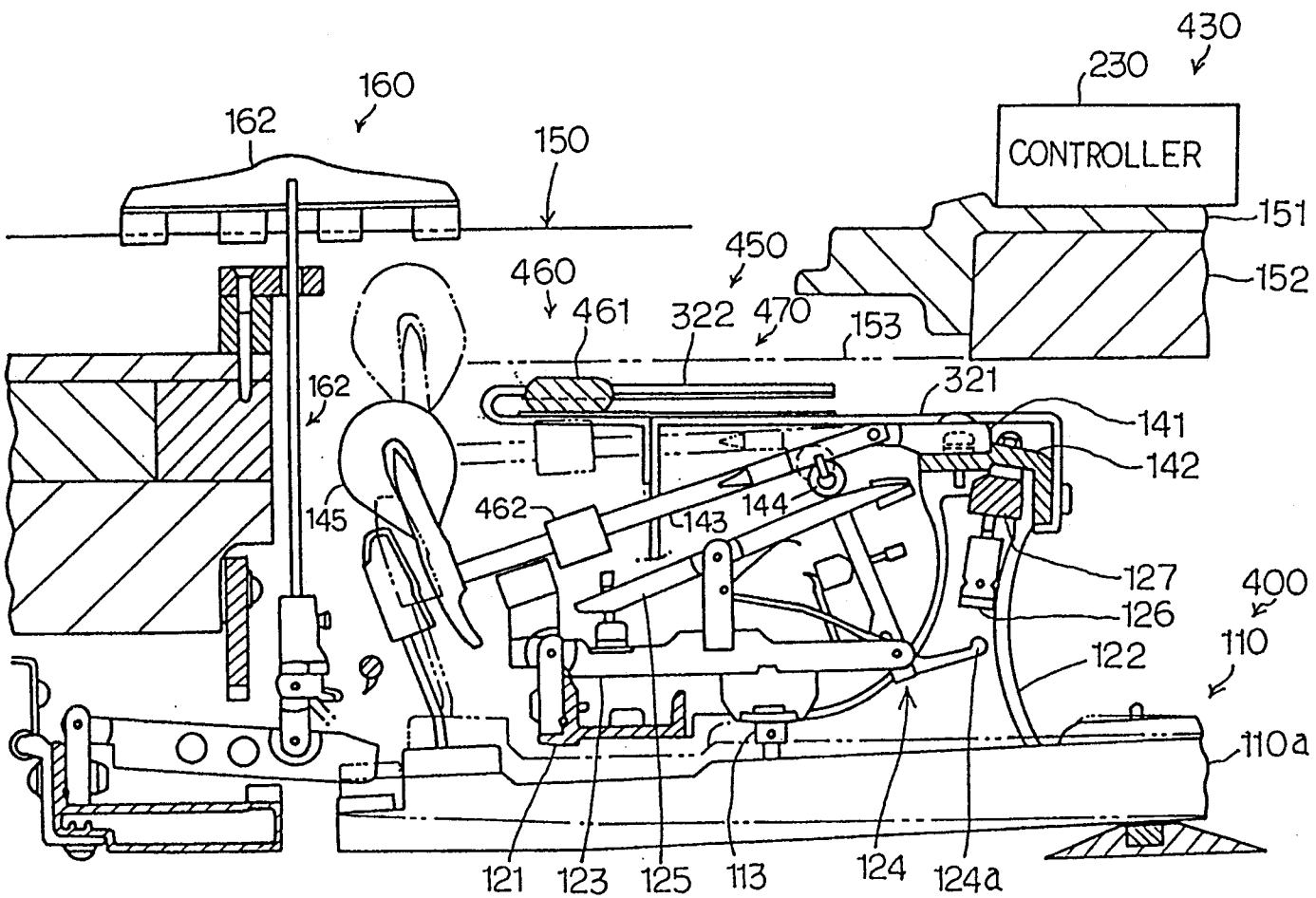
FIG. 7 is a cross sectional side view showing the essential parts of the keyboard instrument in the silent mode.

While the slider 461 is staying a rearmost position, the slider 461 is faced to the cushon members 462 as shown in FIG. 7, and the cushio members 462 are brought into contact with the slider 462 after the escape of the jacks 124 from the hammer rollers 144. The hammer assemblies 140 rebound on the slider 461, and the hammer heads 145 do not strike the associated stirngs 150. When the slider 461 is faced to the cushion members 462, the stopper mechanism 460 enters into the blocking position.

On the other hand, if the slider 461 is moved from the rearmost position toward the frond end of the keyboard instrument, the slider 461 directly faces the hammer shanks 143 as shown in FIG. 5, and the hammer assemblies can strike the assoicated strings 150 without an interruption of the slider 461. If the slider 461 is directly faced to the hammer shanks 143, the stopper mechanism 460 is in the free position.

Figure 8:
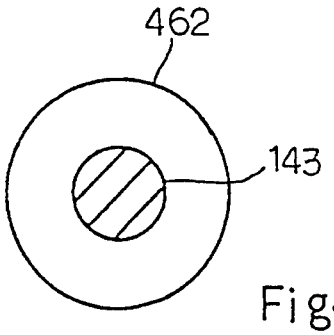
FIG. 8 is a cross sectional view showing a modification of the cushion member available for the mode controlling system.
Figure 9:
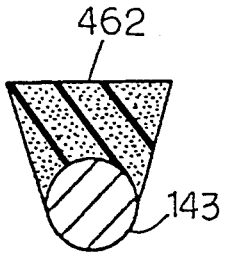
FIG. 9 is a cross sectional view showing another modification of the cushion member available for the mode controlling system.
Figure 10:
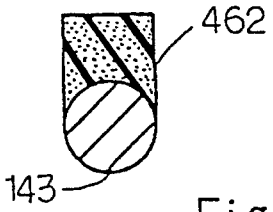
FIG. 10 is a cross sectional view showing yet another modification of the cushion member available for the mode controlling system.
Figure 11:
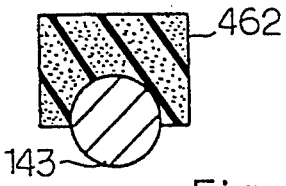
FIG. 11 is a cross sectional view showing still another modification of the cushion member available for the mode controlling system.
Figure 12:
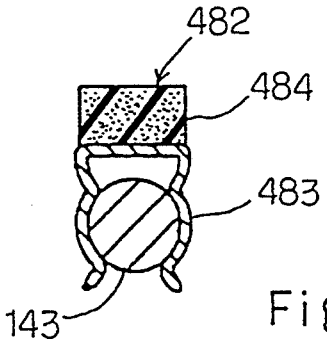
FIG. 12 is a cross sectional view showing a detachable cushion member available for the mode controlling system.

In this instance, the cushion members 462 are tubular as shown in FIG. 8. However, the cushion members may have any cross section illustrated in FIGS. 9 to 11. Moreover, each of the cushion members 462 is replaceable with a cushion member 482 implemented by a snap member 483 atatched to a cushion layer 484, and is avialable for remodeling an acoustic piano.

If a step is formed in the outer surface portion of the cushion member 462, the keyboard instrument can further has a fain mode where the hammer assemblies 140 concurrently strike the spacer 461 and the strings 150.

The keyboard instrument implementing the second embodiemnt behaves in the acoustic mode and the silent mode as similar to the first embodiemnt, and, for this reason, description on these modes is omitted for avoiding repetition.

Third Embodiment

Figure 13:
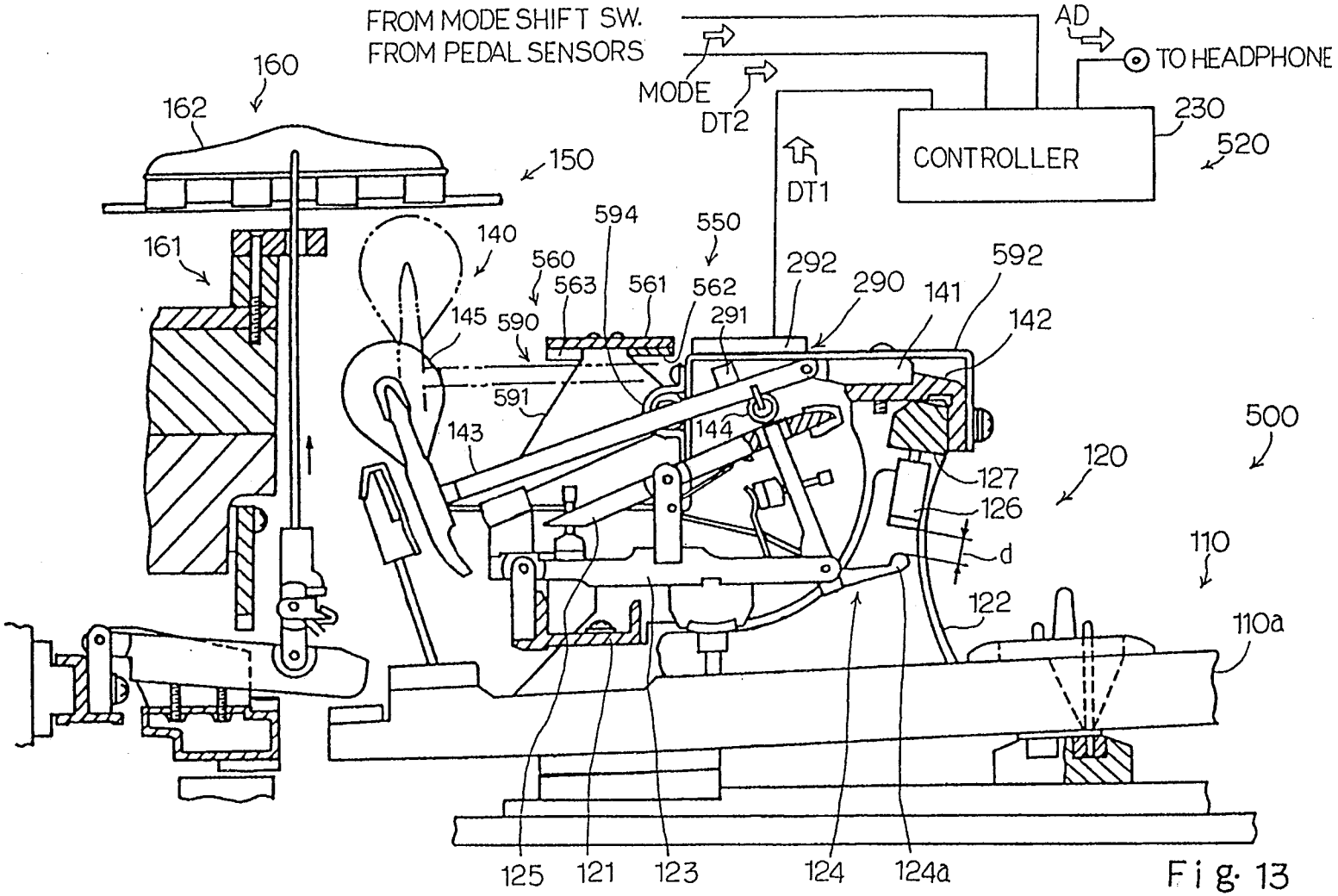
FIG. 13 is a cross sectional side view showing the structure of yet another keyboard instrument according to the present invention.

Turning to FIG. 13 of the drawings, yet another keyboard instrument embodying the present inention also largely comprises a grand piano 500, an electronic sound generating system 520 and a mode controlling system 550, and selectively enters into the acoustic sound mode, and the silent mode. The keyboard instrument may further enter into the recording mode and the playback mode.

The grand piano 500 and the electronic sound generating system 520 are similar to those of the first embodiment, and component members and mechanisms of the grand piano 500 and components of the electronic sound generating system 520 are labeled with the references designating the corresponding members, mechanisms and components without detailed description.

As described in conjunctin with the first embodiment, the grand piano 500 similarly behaves as a grand piano. When the hammer heads 145 reach escaping points 10 millimeters spaced from the associated strings 150 in both acoustic sound and silent modes, the jacks 124 escape from the hammer assemblies 140, and the key action mechanisms 120 and the hammer assemblies 140 give the piano-touch to a player at all times.

The distance d between the toes and the regulating buttons 126 changes the escaping points, and an actuator may move the regulating button 126 depending upon the mode of operation. The present inventor proposed a mechanism for changing the escaping point in Japanese Patent Application No. 5-200581. If the regulating buttons 126 are accompanied with the mechanism, the jacks 124 escape from the hammer assemblies 140 at 2 to 3 millimeters spaced from the strings 150 in the acoustic sound mode and at 10 millimeters spaced from the strings 150 in the silent mode.

The mode controlling system 550 largely comprises a stopper mechanism 560 and a driving mechanism 590, and the driving mechanism 590 changes the stopper mechanism 560 between the free position and the blocking position. The stopper mechanism 560 is located in the vicinity of the hammer heads 145, and the driving mechanism 590 is closer to the hammer shank flanges 141. The mode shift switch 270 may be linked with the driving mechanism 590.

Figure 14:
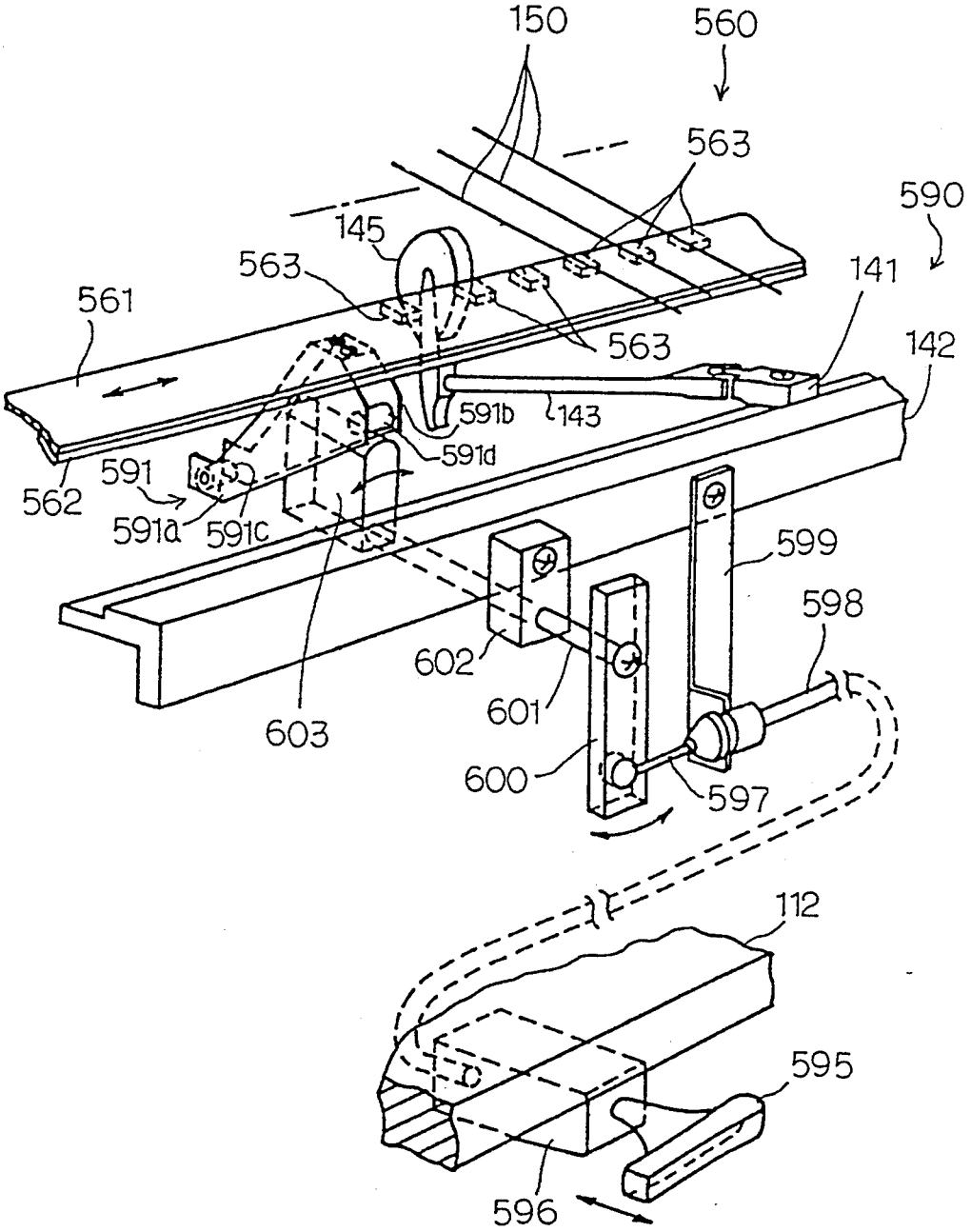
FIG. 14 is a perspective view showing the structure of a mode controlling system incorporated in the keyboard instrument shown in FIG. 13.

As will be better seen from FIG. 14, the stopper mechanism 560 comprises a base plate member 561 extending over the keyboard 110 and shared between all of the eighty-eight keys 110*a* and 110*b*, a reinforcing plate member 562 attached to the lower surface of the base plate member 561 on the front side, and a plurality of cushion members 563 respectively corresponding to the hammer heads 145 and attached to the lower surface of the base plate member 561 at intervals. The interval between adjacent two of the cushion members 563 is equal to the distance between the associated hammer heads 145, and is about 13 millimeters in this instance. The distance between the adjacent two hammer heads 145 is hereinbelow referred to as "pitch".

The driving mechanism 590 comprises five bracket members 591 bolted to both end portions and three intermediate portions of the base plate member 561, because the eighty-eight action mechanisms 120 are divided into four groups corresponding to four spaces defined by the piano frames. Each of the bracket members 591 has two arm members 591*a* and 591*b* spaced apart from each other, and a pair of shafts 591*c* and 591*d* interconnects the arm members 591*a* an 591*b* such that a gap takes place therebetween.

Figure 15:
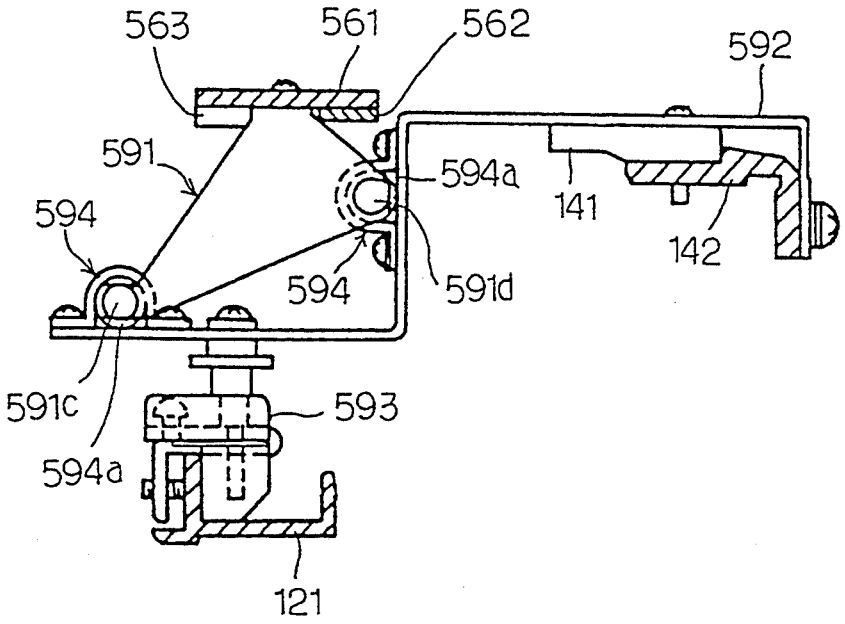
FIG. 15 is a cross sectional side view showing a part of a driving mechanism incorporated in the mode controlling system.

The driving mechanism 590 further comprises supporting bracket members 592 bolted to the hammer shank rail 142 and to the whippen rail 121 through regulating units 593, and bearing units 594 fixed to the supporting bracket members 592. As will be better seen from FIG. 15, each of the supporting bracket member 592 has a step where the bearing units 594 are bolted. The height of each regulating unit 121 is regulable, and appropriately interconnects the whippen rail 121 and the supporting bracket 592. A pair of bearing units 594 is associated with each bracket member 591, and has cloth members 594*a* slidably supporting the shaft members 591*c* and 591*d*.

Turning back to FIG. 14, the driving mechanism 590 further comprises a nob 595 supported through a stationary bracket member 596 by the key bed structure 112, a flexible wire 597 movable in a tube member 598 fixed to a bracket member 599, an bar member 600 fixed at one end thereof to the leading end of the flexible wire 597, a rod member 601 fixed to the other end of the bar member 600 and turnably supported by the shank flange rail 142 through a bracket 602 and a pusher 603 fixed to the leading end of the rod member 601. The pusher 603 is loosely inserted into the gap defined in one of the bracket members 591, and is turnable together with the rod member 601 for moving the base plate member 561 in the perpendicular direction of the strings 150.

In this instance, the nob 595 has two stable points in the stationary block member 112, and the distance between the two stable points is corresponding to the half pitch. However, two stoppers attached to the base plate member 561 or the shaft members 591*c* and 591*d* may restrict the sliding motion of the base plate member 561.

Turning back to FIG. 13, a plurality of hammer sensors 290 are respectively fixed to the supporting bracket members 592, and are operative to monitor the hammer assemblies 140 instead of the key sensors. Each of the hammer sensors 290 is implemented by a shutter plate 291 attached to the associated hammer shank 143 and a photo-coupler 292, and produces the detecting signal DT1 indicative of the motion of the hammer assembly 140.

In operation, a player is assumed to be going to perform a music in an acoustic sound mode, and the nob 595 is pushed into the stationary block member 596. The flexible wire 597 pushes the bar member 600, and rotates the bar member 600 in the clockwise direction around a center axis of the rod member 601. The rod member 601 per se turns around the center axis thereof, and the pusher 603 declines toward the right side in FIG. 14. This means that the pusher 603 pushes the bracket member 591 toward the right side, and the base plate member 561 slides toward the right side by a half of the pitch. As a result, the hammer shanks 143 are faced to the base plate member 561 between the cushion members 563, and the distance between the stopper mechanism 560 and each hammer shank 143 is increased through the sliding motion of the base plate member 561. In other words, the stopper mechanism 560 is spaced from the hammer shanks 143 in the respective home positions, and enters into the free position.

The mode shift switch supplies the mode signal MODE indicative of the acoustic sound mode to the controller 230, and the controller 230 does not produce the audio signal AD.

After the entry into the acoustic sound mode, while the player is performing a music on the keyboard 110, the depressed keys 110*a* and 110*b* cause the associated key action mechanisms 120 to rotate the hammer assemblies 140 in the clockwise direction in FIG. 13, and the key action mechanisms 120 and the hammer assemblies 140 give the piano key-touch to the player at the escapes of the jacks 124. The hammer assemblies 140 strikes the strings 150 without an interruption of the cushion members 563, and rebound on the strings 150. The strings 150 vibrate for producing acoustic tones.

Figure 16:
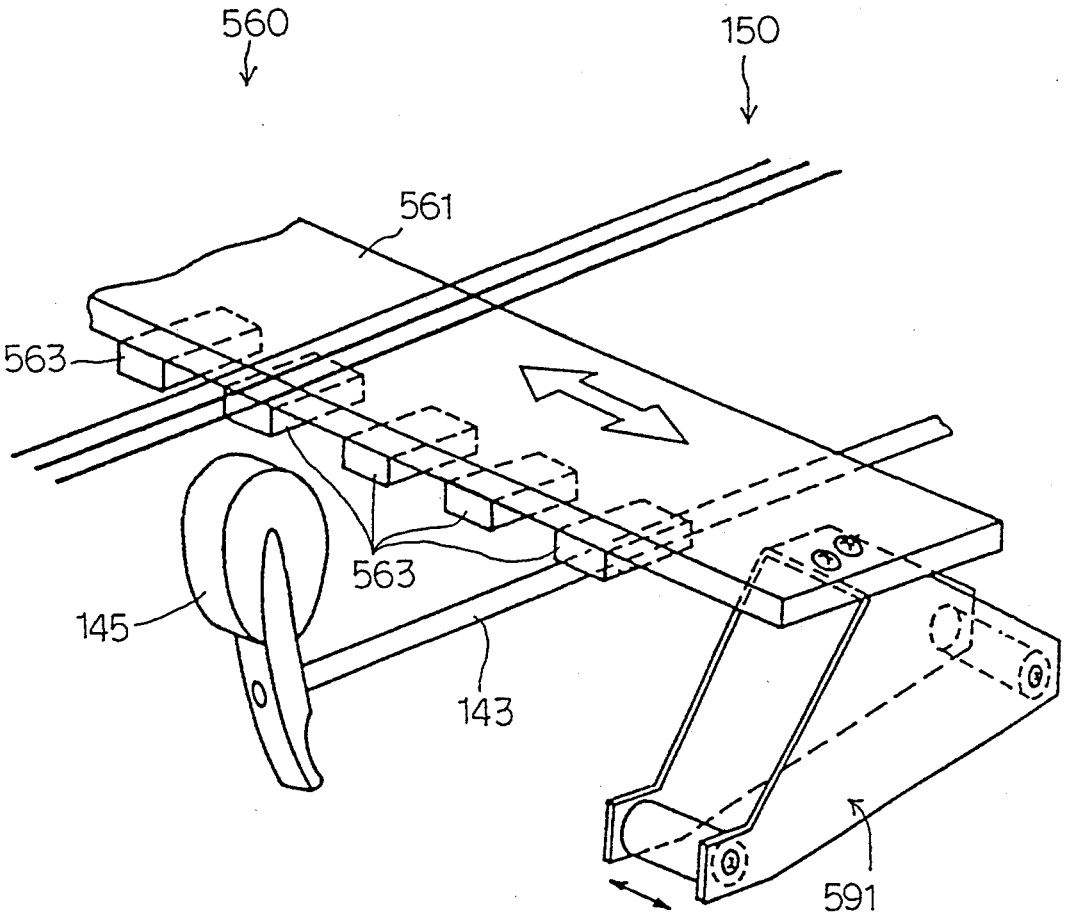
FIG. 16 is a perspective view showing a stopper mechanism incorporated in the mode controlling system.

On the other hand, if the player pulls the nob 595, the flexible wire 597 rotates the bar member 600 in the counter clockwise direction in FIG. 14, and the pusher 603 pushes the bracket 591 toward the left side. The base plate member 561 slides toward the left side by a half pitch, and the cushion members 563 interposed between the hammer shanks 143 and the sets of strings 150 as shown in FIG. 16. The distance from each hammer shank 143 in the home position is decreased, and the stopper mechanism 560 enters into the blocking position. The mode shift switch 270 supplies the mode signal MODE indicative of the silent mode to the controller 230, and the controller 230 becomes ready for a electronic synthesis of the tones.

While the player is performing a music on the keyboard 110, the jacks 124 escape from the hammer assemblies 140, and rotate the hammer assemblies 140 toward the strings 150. When the jack 124 escapes from the hammer assembly 140, the player feels the piano key-touch.

The hammer shanks 143 rebound on the cushion members 563 before strikes, and the strings 150 never vibrate. However, the controller 230 synthesizes tones with the notes assigned to the depressed keys 110*a* and 110*b*, and the player can hear the synthetic tones through the headphone.

Thus, the keyboard instrument embodying the present invention is changed between the acoustic mode and the silent mode through the sliding motion of the driving mechanism 590, and gives the piano key-touch to the player in both acoustic sound and silent modes.

Figure 17:
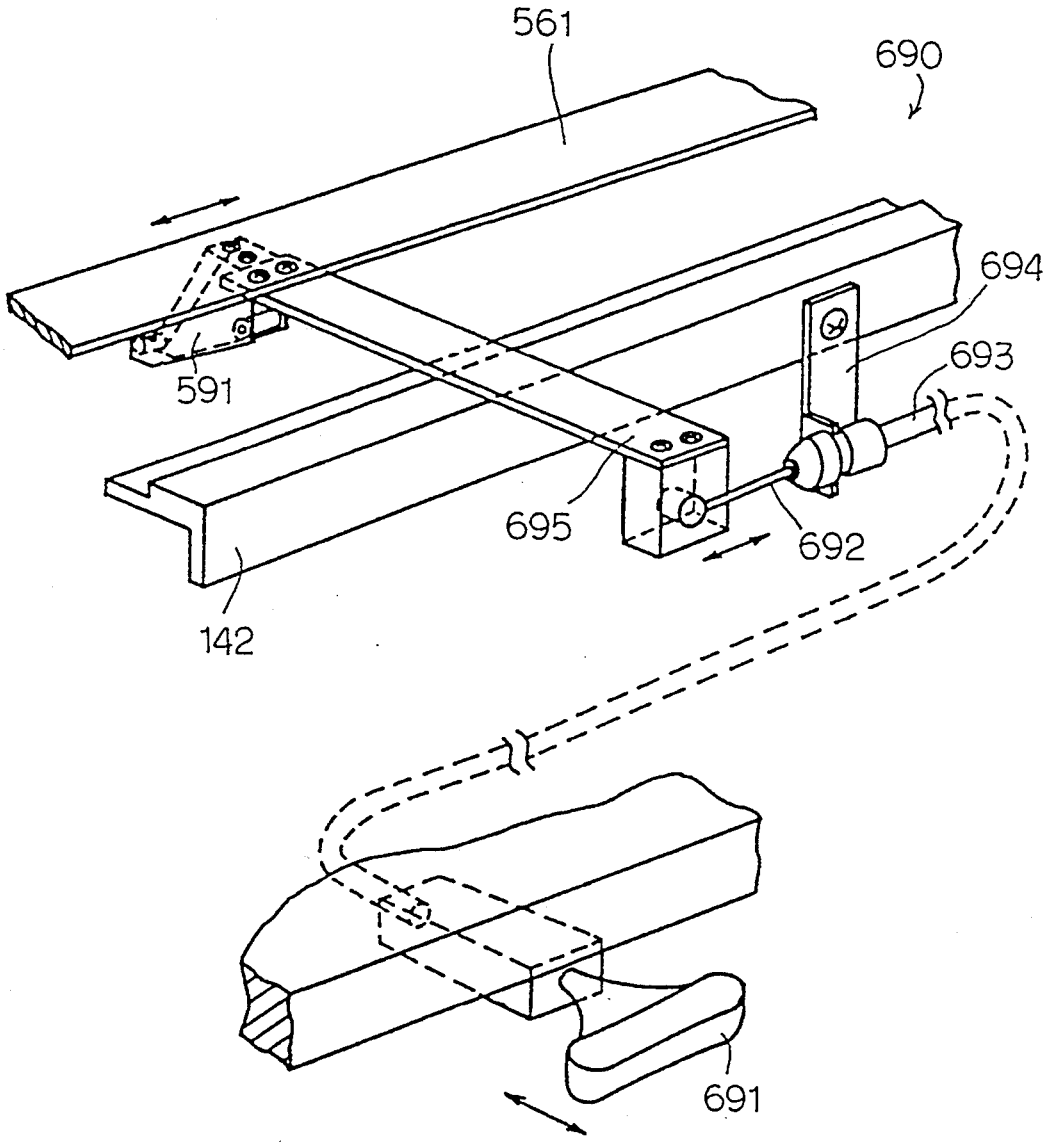
FIG. 17 is a perspective view showing a modification of the mode controlling system.

FIG. 17 shows another driving mechanism 690 replaceable with the driving mechanism 590, and comprises a nob 691, a flexible wire 692 slidable in a tube member 693, a bracket member 702 connected between the shank flange rail 142 and the tube member 693, a plate member 695 connected between the flexible wire 692 and the base plate member 561. Though not shown in FIG. 17, a guide member is associated with the plate member 695, and allows the plate member 695 to slide by a half pitch together with the base plate member 451.

The nob 691 is manipulated by a player, and the driving mechanism 690 laterally moves the base plate member 561 for changing the stopper mechanism between the free position and the blocking position.

The nob 595/691 and the flexible wire 597/692 are replaceable with a solenoid operated actuator or a combination of a motor unit and a suitable mechanism such as a chain and sprockets. Moreover, the nob and the flexible wire may be replaced with a pedal and a link mechanism, and the bracket members 591 may be driven by respective pushers 603 or the respective plate members 695.

Although particular embodiments of the present invention have been shown and described, it will be obvious to those skilled in the art that various changes and modifications may be made without departing from the spirit and scope of the present invention. For example, the electronic sound generating system and the mode controlling system may be incorporated in an upright piano.

What is claimed is:

1. A keyboard instrument having at least an acoustic sound mode for producing acoustic sounds and an electronic sound mode for producing synthetic sounds, comprising:

a) an acoustic piano having a-1) a keyboard implemented by a plurality of swingable keys depressed by a player in both acoustic sound and electronic sound modes, notes of a scale being assigned to said plurality of swingable keys, a-2) a plurality of key action mechanisms respectively linked with said plurality of swingable keys, and selectively actuated by depressed keys of said keyboard in both acoustic sound and electronic sound modes, a-3) a plurality of hammer assemblies respectively associated with said plurality of key action mechanisms, and selectively driven for rotation by actuated key action mechanisms linked with said depressed keys in both acoustic sound and electronic sound modes, said actuated key action mechanisms and the associated hammer assemblies producing a piano-touch in both acoustic sound and electronic sound modes, and a-4) a plurality of string means respectively associated with said plurality of hammer assemblies, and selectively struck by hammer assemblies driven by said actuated key action mechanisms in said acoustic sound mode for producing said acoustic sounds, a gap between each hammer assembly and the associated string means being increased from an axis of rotation thereof toward an leading end portion thereof while the associated key in a rest position allows said each hammer assembly to stay in a home position;

b) an electronic sound generating system enabled in said electronic sound mode for producing synthetic sounds having notes identified by said depressed keys; and c) a mode controlling system having c-1) a stopper means provided in said gap and movable at least between a free position in said acoustic sound mode and a blocking position in said electronic sound mode, said blocking position being closer to said plurality of hammer assemblies in the home positions, and c-2) a driving means associated with said stopper means and movable along said plurality of string means for changing said stopper means between said free position and said blocking position, said hammer assemblies striking said string means without an interruption of said stopper means in said free position, said hammer assemblies being brought into contact with said stopper means in said blocking position without a strike against said string means.

2. The keyboard instrument as set forth in claim 1, in which said driving means is closer to rotational the axes of said plurality of hammer assemblies than said stopper mechanism.

3. The keyboard instrument as set forth in claim 2, in which said acoustic piano is a grand piano, said driving means comprising a guide means providing a sliding path along said plurality of string means and supported by action bracket means which support said plurality of key action mechanisms and said plurality of hammer assemblies, and a pusher slidable along said sliding path, said stopper means comprising a deformable frame means supported by said guide means and elastically deformed by said pusher, and a cushion means supported by said deformable frame means and faced to hammer shanks of said plurality of hammer assemblies, said cushion member becoming closer to said hammer shanks for allowing said stopper means to enter into said blocking position when said pusher elastically deforms said deformable frame means, said cushion means being spaced from said hammer shanks due to an elastic force of said deformable frame means for causing said stopper means to enter into said free position when said pusher is left from said deformable frame means.

4. The keyboard instrument as set forth in claim 2, in which said acoustic piano is a grand piano, said driving means comprising a guide means providing a sliding path along said plurality of string means and supported by action bracket means which support said plurality of key action mechanisms and said plurality of hammer assemblies, and an actuator means powered when said keyboard instrument is changed between said acoustic sound mode and said electronic sound mode, said stopper means comprising a sliding means actuated by said actuator means for sliding along said sliding path, and a plurality of cushion members respectively supported by hammer shanks of said plurality of hammer assemblies, said sliding means being moved to be faced to said plurality of cushion members for allowing said stopper means to enter into said blocking position, said sliding means being moved out of orbits of said plurality of cushion members for causing said stopper means to enter into said free position.

5. The keyboard instrument as set forth in claim 2, in which said acoustic piano is a grand piano, said stopper means comprising a plate means provided between said plurality of hammer assemblies and said plurality of string means in a slidable manner in a perpendicular direction of said plurality of string means, and supported by action bracket means which support said plurality of key action mechanisms and said plurality of hammer assemblies, and a plurality of cushion members attached to a lower surface of said plate means at intervals each approximately equal to a pitch of said plurality of hammer assemblies in said perpendicular direction, said driving mechanism causing said plate means to slide by a half of said pitch so that said plurality of hammer assemblies are faced to said plate member between said plurality of cushion members in said acoustic sound mode and to said plurality of cushion members in said electronic sound mode.

* * * * *